US005114021A

United States Patent [19]

Fredrickson

[11] Patent Number: 5,114,021

[45] Date of Patent: May 19, 1992

[54] SELF FEEDING DISPLAY PEG

[75] Inventor: Howard J. Fredrickson, Cannon Falls, Minn.

[73] Assignee: IMI Cornelius Inc., Anoka, Minn.

[21] Appl. No.: 364,346

[22] Filed: Jun. 9, 1989

[51] Int. Cl.[5] ..... A47F 7/00

[52] U.S. Cl. ..... 211/54.1; 211/59.1

[58] Field of Search ..... 211/54.1, 59.1, 57.1, 211/51, 59.3; 248/220.4, 222.3; 40/657

[56] References Cited

U.S. PATENT DOCUMENTS 3,007,580 11/1961 Dickson, Jr. ..... 211/59.3
3,161,295 12/1964 Chesley ..... 211/59.3
3,200,960 8/1965 Banse ..... 211/182 X
4,303,162 12/1981 Suttles ..... 211/59.3

*Primary Examiner*—Carl D. Friedman
*Assistant Examiner*—Sarah A. Lechok
*Attorney, Agent, or Firm*—Sten Erik Hakanson

[57] ABSTRACT

A self feeding peg and pegbar have a pair of elongate parallel support members extending outward from a mounting structure to a common nose, a goods pusher slideably mounted upon the support members, and a negator spring having a coil behind the pusher and a fixed end secured to the peg nose. The method has the step of pulling the pusher and goods forward with the negator spring being extended through the goods.

10 Claims, 4 Drawing Sheets

SELF FEEDING DISPLAY PEG

BACKGROUND OF THE INVENTION

1. Field of the Invention

This invention pertains to a self-feeding display device and to a method of displaying and feeding goods.

2. The Prior Art

Pegbar display devices are well known and commonly used. They are found in most retailing establishments and virtually every person has purchased something off of a pegbar display.

Typical goods displayed on and purchased from pegbar displays are pre-packaged meat, cheese, batteries, film, tools, car parts, toys, and so on.

Gerald D. Pedersen U.S. Pat. No. 4,610,413 provides a pegbar device which is a direct predecessor of this invention and has a pegbar with spaced apart keyholes, and a single strength cantilevered peg with a ¼ turn lock structure at the rear. This particular lock structure is utilized in this invention as will be described.

Howard J. Fredrickson U.S. Pat. No. 4,606,466 utilized the Pedersen device and provided for structure for presenting graphic information and identification, specifically a sign and a sign holder.

The inventions of Pedersen and Fredrickson work very well and are in extensive and growing commercially successful use.

The Pedersen and Fredrickson inventions are available from Cannon Equipment Co., Cannon Falls, Minn. 55009 and are sold under the trademarks "MAGNA-BAR" and "TWIST 'N PULL".

The entities that display goods have wanted to provide deeper displays, present and display larger and heavier packages, and present new and heavier goods on pegbar displays.

The pegs of the Pedersen invention have been available and are successful in usable display lengths of 10, 12, or 15 inches. The goods merchandising people now want pegs approaching the length of a person's arm, for example pegs that are 20 to 24 inches long. The closed section cross bar or support of Pedersen's invention is fully capable of carrying longer pegs and/or more weight without beam or torsional bending. A solution to this has been provided in a double strength pegbar devised by Merle A. Larson and which is the subject of commonly owned co-pending U.S. Ser. No. 094,168 filed on Sep. 8, 1987.

Now these retailing entities want self-feeding of product on these pegbars. To date there has been no solution for this need.

OBJECTS OF THE INVENTION

It is an object of this invention to provide a new and improved apparatus and method for display and self-feeding of goods to the front of a pegbar.

It is an object of this invention to provide a new and improved self-feeding peg.

It is an object of this invention to provide a new and improved self-feeding pegbar.

It is an object of this invention to provide an improved method of displaying and feeding goods on a peg.

SUMMARY OF THE INVENTION

According to the principles of the present invention, a self-feeding display peg has a pair of elongate and parallel structural members for support of goods, an outer nose, mount structure on the back end, a goods pusher slideably mounted on the members, a negator spring having a fixed end secured to the nose, and structure in the pusher for holding the spring in between the structural members.

A self-feeding pegbar has support structure for holding pegs, at least one double peg, a goods pusher slideably mounted on the peg, a negator spring having a fixed end secured to a nose of the peg, and structure for holding the negator coil within the double peg.

A method of displaying and feeding goods has the steps of supporting the goods on a double peg, pushing the goods forward with a pusher slideably mounted on the peg, pulling the pusher with a negator spring, and pulling the negator spring through the goods being fed.

Many other advantages, features, and additional objects of the present invention will become manifest to those versed in the art upon making reference to the detailed description and accompanying drawings in which the preferred embodiment incorporating the principles of the present invention is set forth and shown by way of illustrative example

DESCRIPTION OF THE PREFERRED EMBODIMENT

Figure 1:
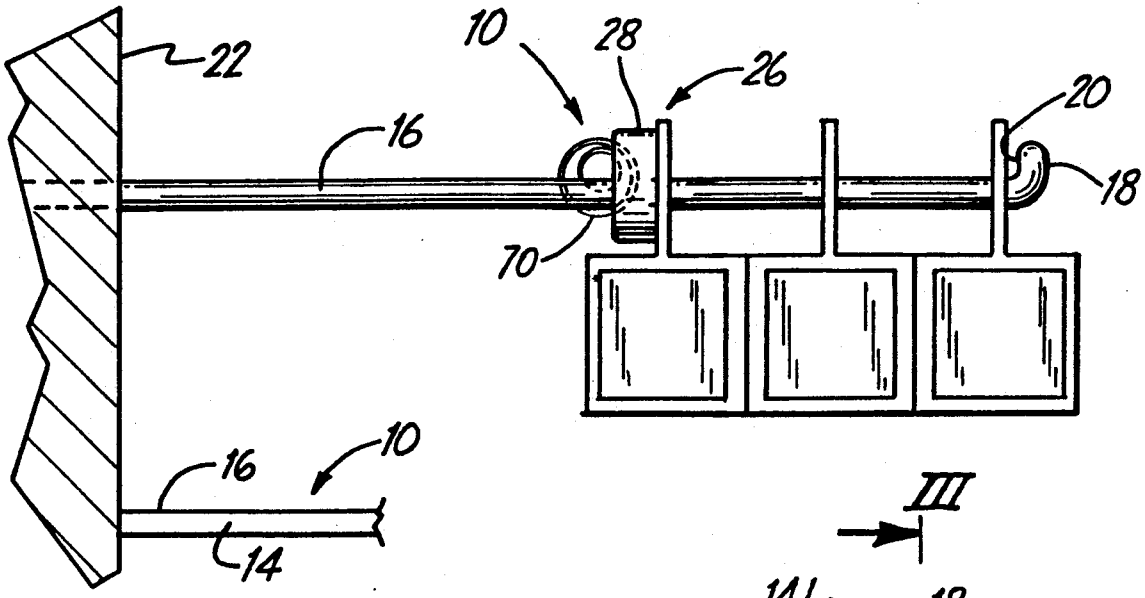
FIG. 1 is a side elevational view of the preferred embodiment of the self-feeding pegbar of the present invention.
Figure 2:
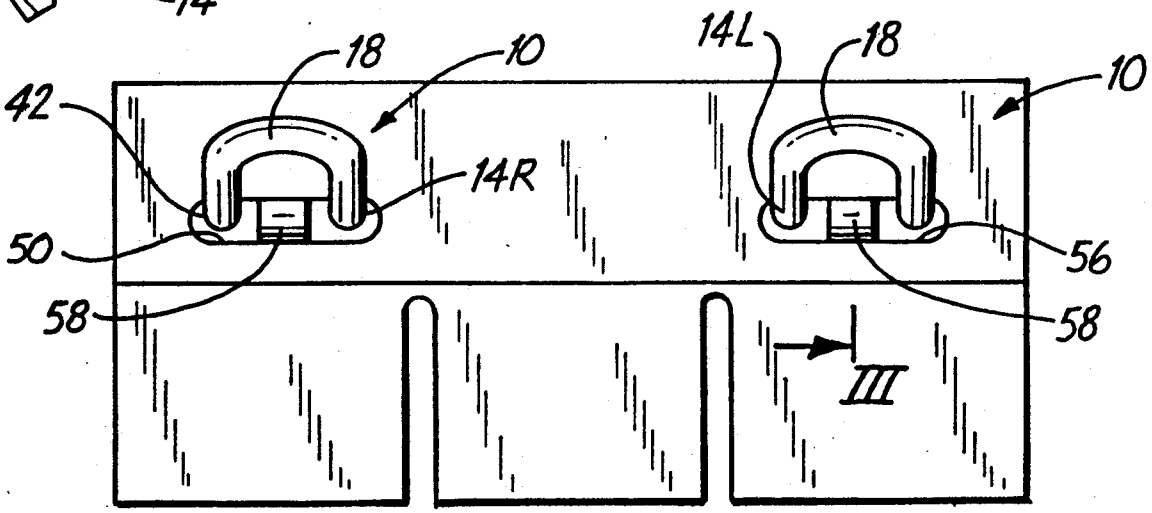
FIG. 2 is a front elevational view of the structure of FIG. 1.
Figure 3:
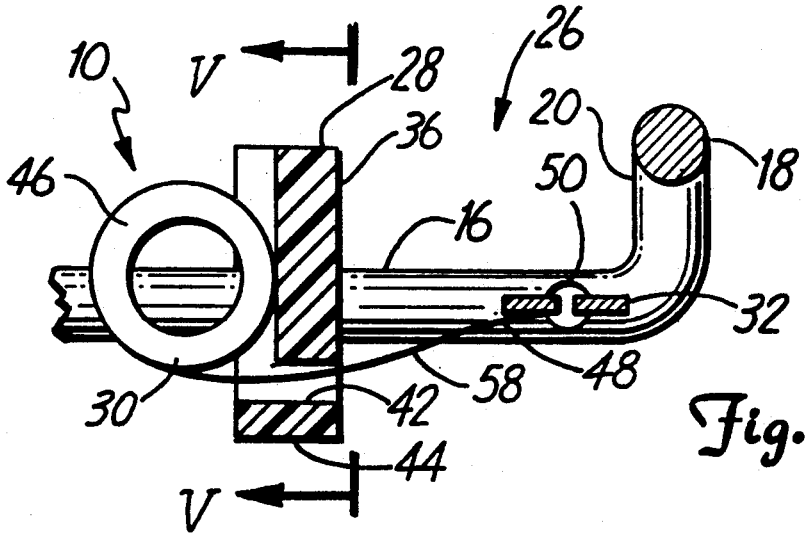
FIG. 3 is a side elevational view in section taken through lines III—III of FIG. 2.
Figure 4:
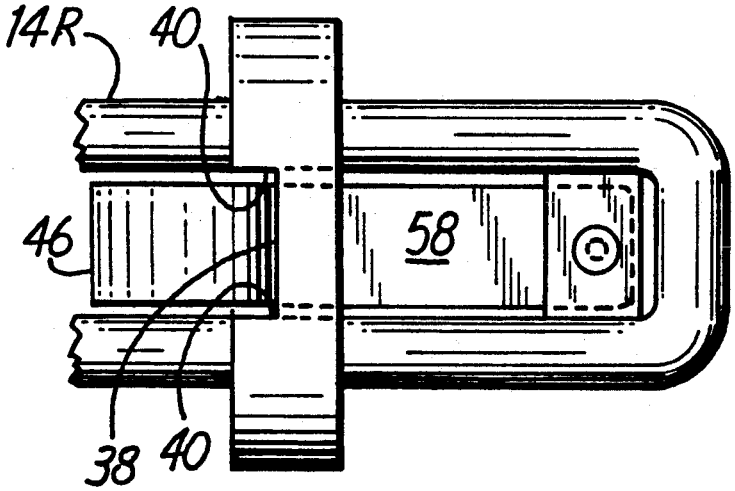
FIG. 4 is a top plan view of the structure in FIG. 3.
Figure 5:
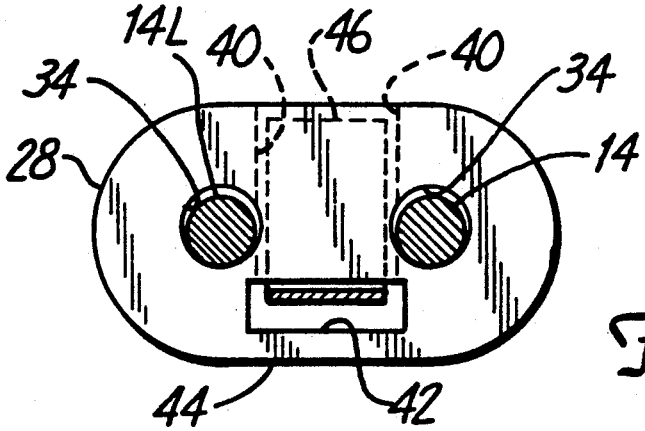
FIG. 5 is a front elevational view taken through lines V—V of FIG. 3.

FIGS. 1 and 2 show a peg, generally indicated by the numeral 10, that is supporting and displaying a plurality of suspended goods 12. A specific goods 12 such as is shown, may be a 6-pack of single serve pudding or dessert. Typically, the goods 12 will be relatively heavy and require a relatively strong peg 10. The peg 10 has a generally U-shaped support having a pair of elongate and parallel structural members 14 (left and right) which each have an upper surface 16 for support of the goods 12. A nose 18 adjoins the members 14L, 14R, forming a generally U-shaped structure in which each member 14L, 14R, extends inwardly as a cantilever from the nose 18. The nose 18 has on its backside, a stop surface 20 to limit forward movement of the goods 12. The peg 10 is mounted to a relatively fixed structure 11 and there usually will be several levels of pegs 10 mounted one above another in transverse rows. A preferred fixed structure is the support bar shown in FIGS. 7 and 8 and designated as 22B. A preferred mounting structure on the back end of the pegs 10 is a partial-turn key structure 24 best seen in FIGS. 8, 9, 10, and 11.

The support bar 22B and the partial turn lock key 24 which is on at least one of the members 14L, 14R, is fully described both in structure and in function in commonly owned U.S. Pat. No. 4,610,413 of Sep. 9, 1986 by Gerald D. Pedersen, the entire teachings of which are incorporated hereinto by reference.

The double strength peg having the U-shape structure 11 and a pair of lock keys 24 is fully described both in structure and function in commonly owned co-pending U.S. Ser. No. 094,168 filed Sep. 8, 1987 by Merle A. Larson, the entire teachings of which are incorporated hereinto by reference.

The important feature of both the structure and method of this invention is the self-feeding structure generally indicated by the numeral 26, hereinafter called the feeder 26 for purposes of brevity. The feeder 26 includes a goods pusher 28 slideably mounted upon the support members 14L, 14R, a negator type spring 30, and a spring perch 32 to which the spring 30 is fastened.

The pusher 28 is preferably a block of low friction plastic and has a pair of spaced apart bearing bores 34 which are large enough to slip over the lock keys 24 and which are a relatively sloppy slip-fit on the support members 14L, 14R. The pusher 28 will freely slide back and forth the entire length of the peg 10 and on and off of the lock keys 24, but is abutted and stopped by the nose stop 20 so it cannot come off the front of the peg 10. The pusher 28 has a front surface 36 which engages and pushes the goods 12 forward. The pusher 28 goes completely around and completely encloses both support members 14L, 14R. On the back side of the pusher 28 is a spring pocket 38 which has transverse sides 40 which are each positively spaced inward from the adjacent support members 14L, 14R. At the bottom of the pocket 38 is a spring positioning aperture 42 which is bounded on its lower side by a sliding spring support 44. Both the spring aperture 42 and spring support 44 are positioned below and spaced from the support surfaces 16 of the support members 14L, 14R.

The negator spring 30 has a sliding coil 46 which goes back and forth with the pusher 28 and a fixed end 48 which is fixedly fastened to the spring perch 32 by a nut and bolt or rivet 50. The spring perch 32 may be a flat and rectangular piece of sheet metal which is welded to each support member 14L, 14R. As the pusher 28 and coil 46 go back, the coil 46 unrolls and the pusher 28 comes forward, the coil 46 rolls up. The negator spring 30 holds the pusher 28 upon the peg 10. The negator spring 30 is a coiled up ribbon of stainless steel spring stock that exerts an essentially constant force against the back side of the pusher 28.

Figure 6:
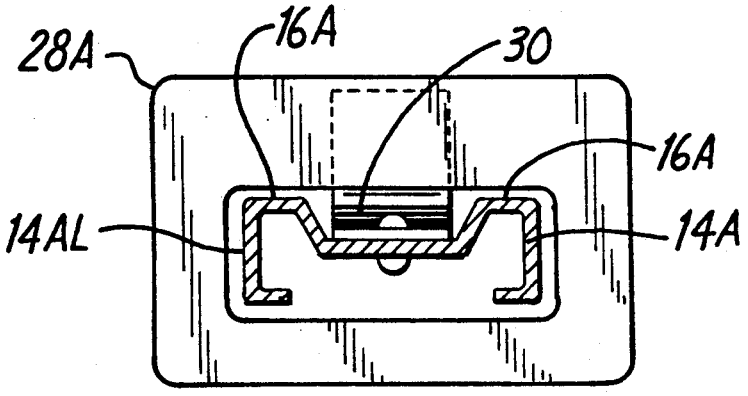
FIG. 6 is a front elevational view of an alternative embodiment of the present invention.

An alternative structural member llA is shown in FIG. 6, with a roll-formed sheet metal section having a pair of spaced apart support beam members 14AL, 14AR, and goods support surfaces 16AL, 16AR. As is evident, other structural embodiments of this invention are devisable.

Figure 7:
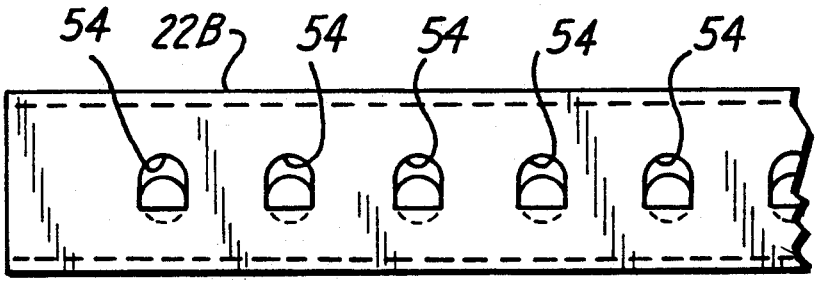
FIG. 7 is a front elevational view of a peg support bar for use in the structure of FIG. 1.
Figure 8:
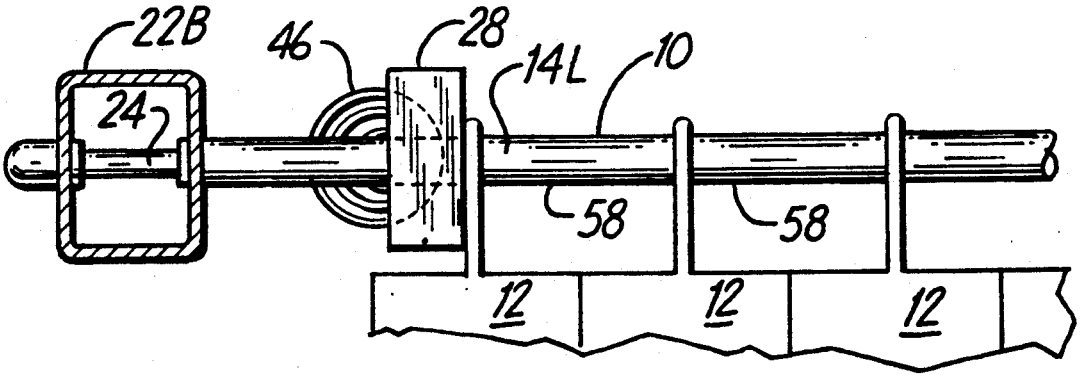
FIG. 8 is a side elevational view of the bar of FIG. 7 and peg of FIG. 1 in use together.

FIGS. 7 and 8 illustrate the complete pegbar 52 comprised of the support bar 22B and one or more pegs 10. A preferred use for the pegbar 10 is to place two pegs 10 side-by-side at the same level and jointly support and feed a single goods package 12 such as is shown in FIG. 2 wherein product may be suspended and fed between the pegs 10.

Figure 9:
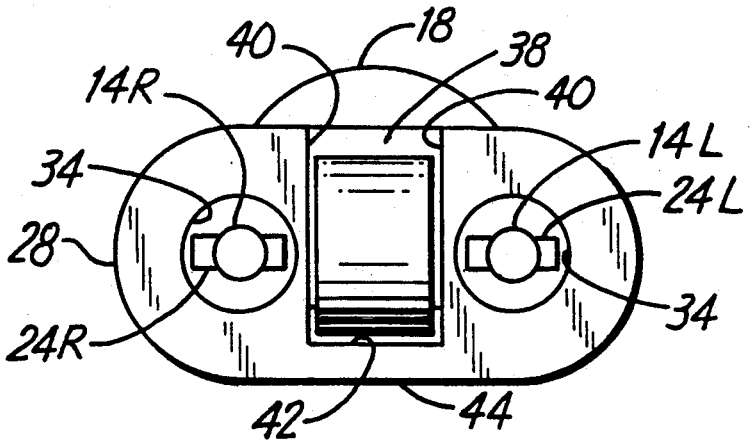
FIG. 9 is a rear elevational view taken through lines IX—IX of FIG. 10.
Figure 10:
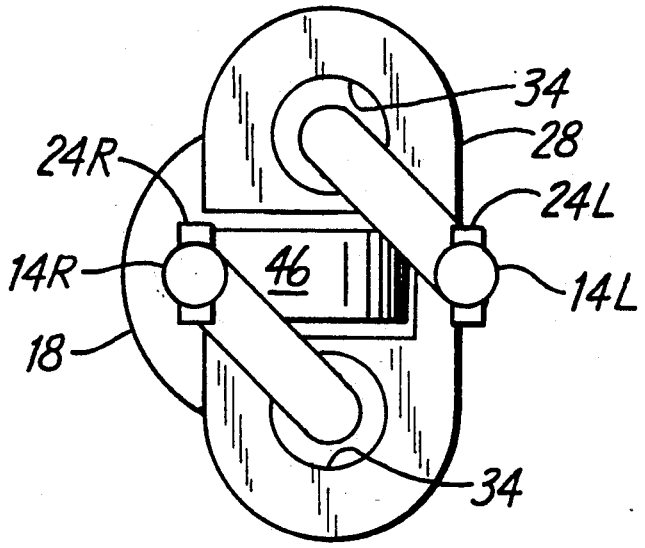
FIG. 10 is a rear elevational view of the structure of FIG. 9 twisted into a configuration to unlock its keys.
Figure 11:
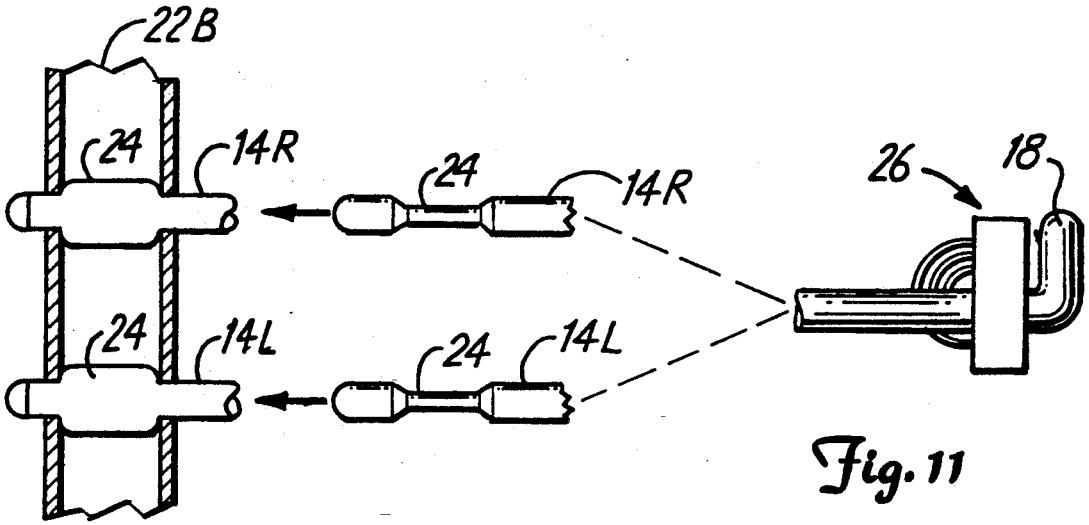
FIG. 11, is a top plan view illustrating operation of the partial turn lock keys of the structure of FIG. 7.

FIG. 9 shows the back end of the peg 10 with the two lock keys 24L, 24R (L/R designation being reversed because the back is shown) in their normal positions. The keyholes 54 for the lock keys 24 are taller than they are wide, while the lock keys are wider than they are tall. The lock keys 24L, 24R, must both be turned 90° about the axis of the support members 14L, 14R, and this is accomplished by twisting the nose 18 and pusher 28 with respect to the lock keys 24 as is shown in FIG. 10. FIG. 11 on the right side shows the peg 10 twisted with the lock keys 24 turned up for entry or release into or from the keyholes 54 and the peg 10 then resiliently snaps itself into its normal configuration when in the support bar 22B.

Each of the goods 12 has a generally racetrack or obround shaped hanging aperture 56 through which the support member 14L, 14R, both extend. The uncoiled length 58 of the negator spring 70 is also extended through the goods 12 in the hanging aperture 56 as is best shown in FIGS. 2 and 8.

In the use and operation of the peg 10 and pegbar 52, and in the practice of the method of this invention, the peg 10 is mounted in the fixed structure 22 or support bar 22B. The goods 12 are pushed on to the peg 10 firstly over the nose 18 and then rearward on the support members 14L, 14R. As the pusher 28 is pushed rearward, the coil 46 unrolls and the unrolled length 58 is within the goods apertures 56. The negator spring 30 and pusher 28 then continually push all of the goods 12 forward and keep goods 12 at the front stop 20 of the peg 10.

As the pusher 28 slides back and forth on the support members 14L, 14R, the spring coil 46 is held captured in and by the pocket 38 and support 42. The coil 38 is kept concealed behind the pusher 28 and is normally not seen by or accessible to the public. The coil 38 is kept between the members 14L, 14R as it is unrolled and/or rolled up. The unrolled portion 58 is captured and held and supported by the goods 12 and kept close to and just below the support surfaces 16 and does not flop around and present a danger to users.

This new peg 10, pegbar 52, and method are cost effective, safe, visually acceptable, quiet, easy to use, and present several other advantages.

Although other advantages may be found and realized and various modifications may be suggested by those versed in the art, it should be understood that I wish to embody within the scope of the patent warranted hereon, all such embodiments as reasonable and properly come within the scope of my contribution to the art.

I claim as my invention:

1. A self-feeding pegbar comprising a) support structure for holding at least one level of pegs;

b) at least one double peg mounted in said structure at said level;

c) a goods pusher slideably mounted on said peg;

d) a negator spring having a fixed end secured to a nose of said peg and a coil resiliently engaging said pusher for biasing said pusher and goods upon said peg toward said nose;

e) means in said pusher for holding said negator coil within said double peg; and in which f) said peg has two side-by-side elongate support members cantilevered from said nose, and a key on a back end of at least one of said members, said key being operatively rotable about an axis of said one member to lock and unlock said peg to and from said support structure.

2. The pegbar of claim 1, in which said pusher is held on said peg by said negator spring.

3. The pegbar of claim 2, including a said key on the back end of both said members.

4. The pegbar of claim 1, including a pair of said pegs at said one level, said pegs being transversely spaced from each other, and a single goods jointly supported by and pushed forward by both said pegs, said goods having at least some product hanging in between said spaced apart pegs.

5. A method of displaying and feeding goods comprising the steps of a) supporting the goods upon a double support member peg;

b) pushing the goods forward upon the peg to a position of display adjacent a nose of the peg, with a pusher slideably mounted upon the peg;

c) pulling the pusher forward with a negator spring; and d) pulling the negator spring through the goods during said steps of supporting, pushing and pulling.

6. The method of claim 5, including the further steps of at least partially supporting the negator spring with the goods.

7. The method of claim 5 including the further step of vertically capturing the negator spring in both upward and downward directions with the pusher and with the goods.

8. The method of claim 5 including the further step of holding the pusher on the peg exclusively with the negator spring.

9. A method of displaying and feeding goods comprising the steps of a) supporting the goods upon a double support member peg;

b) pushing the goods forward upon the peg to a position of display adjacent a nose of the peg, with a pusher slideably mounted upon the peg;

c) pulling the pusher forward with a negator spring;

d) pulling the negator spring through the goods during said steps of supporting, pushing and pulling; and e) rotating said members in said pusher to lock and unlock said peg from a peg supporting structure.

10. A self-feeding display peg, comprising a) a pair of elongate and parallel structural members for support of goods thereon;

b) a nose on an outer end of said peg, said nose having an abutment for stopping and keeping the goods upon the peg;

c) mounting means on a back end of said peg for mounting said peg to a peg support;

d) a goods pusher slideably mounted on said members, said pusher being slideable back and forth on the length of the members;

e) a negator spring having a fixed end secured to said nose and a coil resiliently engaged against said pusher for biasing said pusher and any goods upon the members toward the nose;

f) holding means in said pusher for holding said spring in between said members; and in which g) said peg has two side-by-side said elongate support members cantilevered from said nose, and a key on a back end of at least one of said members, said key being operatively rotatable about an axis of said one member to lock and unlock said peg to and from said support structure.

* * * * *